US005375300A

United States Patent [19]

Chen

[11] Patent Number: 5,375,300

[45] Date of Patent: Dec. 27, 1994

[54] CLIP DEVICE FOR SEALING A BAG

[76] Inventor: David Chen, No. 2, Lane 269, Sec. 2, Tung-Men Rd., Tainan City, Taiwan, Prov. of China

[21] Appl. No.: 135,339

[22] Filed: Oct. 13, 1993

[51] Int. Cl.[5] ..... B65D 77/00

[52] U.S. Cl. ..... 24/305. R; 24/498; 24/543; 24/563

[58] Field of Search ..... 24/30.5 R, 30.5 L, 30.5 W, 24/30.5 P, 517, 498, 615, 616, 67.9, 67.11, 563, 543

[56] References Cited

U.S. PATENT DOCUMENTS

| | | | |
|---|---|---|---|
| 2,721,245 | 10/1955 | Arisman et al. | 24/615 |
| 3,121,932 | 2/1964 | Grafstein | 24/517 |
| 3,823,443 | 7/1974 | Takabayashi | 24/543 |
| 3,854,482 | 12/1974 | Laugherty et al. | 24/543 |
| 4,296,529 | 10/1981 | Brown | 24/30.5 P |
| 4,669,152 | 6/1987 | Alexander | 24/30.5 R |
| 4,745,662 | 5/1988 | Chang | 24/67.11 |
| 4,847,956 | 7/1989 | Levine | 24/30.5 R |
| 4,899,974 | 2/1990 | Wear et al. | 24/67.11 |
| 5,050,272 | 9/1991 | Robinson et al. | 24/30.5 R |

*Primary Examiner*—Victor N. Sakran

*Attorney, Agent, or Firm*—Oblon, Spivak, McClelland, Maier, & Neustadt

[57] ABSTRACT

A clip device includes an elongated base plate, an elongated pressing plate pivoted to the base plate, and an elongated elastic block fixed on the base plate under the pressing plate. The elongated base plate has a first pivot portion located at an end portion thereof, and two adjacent flexible retaining portions located at the other end portion. Each of the retaining portions has a vertical body and a barb-like upper end. The barb-like upper ends respectively extend outward from the vertical bodies in opposite horizontal directions. The elongated pressing plate has a second pivot portion located at an end portion thereof and mounted pivotally on the first pivot portion, and two engagement hole portions located at the other end portion and over the retaining portions of the base plate. The engagement hole portions can be turned downward to engage the retaining portions respectively when the retaining portions are pushed inward. The elongated elastic block is fixed on the top surface of the base plate between the first pivot portion and the retaining portions. The bottom surface of the pressing plate contacts the top surface of the elastic block on at least one continuous contact line which extends from one end portion of the elastic block to the other end portion of the elastic block.

8 Claims, 8 Drawing Sheets

CLIP DEVICE FOR SEALING A BAG

BACKGROUND OF THE INVENTION

1. Field of the Invention

This invention relates to a clip device, more particularly to a clip device which can effectively seal a bag.

2. Description of the Related Art

There are many different kinds of foods, such as crackers, peanuts, beans, etc., which are available in our daily lives and which are placed in a food bag in order to prevent exposure of the food to the atmosphere so as to prolong the storage life of the same. Although some of these foods can be placed inside a refrigerator in order to maintain the storage life of the same after the food bag is opened, other foods are unsuited for storage in a refrigerator, thereby making it difficult to maintain the storage life of the same after the food bag has been opened. Moreover, insects, such as flies and ants, which usually carry harmful germs and bacteria, can enter the food bag after the latter has been opened. In addition, when the food in the food bag is exposed to the atmosphere, the food loses its freshness and spoils easily due to the growth of harmful bacteria.

Referring to FIG. 1, a conventional clip device (A) is used for sealing a bag (B). The clip device (A) is made of a metal material or a hard plastic material and provides only one sealing line when in use. When it is desired to close the bag (B), the cutout portion of the bag (B) has to be crumpled to an extent so as to enable the clip device (A) to clamp the bag (B). However, crumpling of the bag (B) may result in several cracks at a single sealing line that is provided by the clip device (A) when the clip device (A) clamps the cutout portion of the bag (B). Accordingly, the clip device (A) cannot effectively seal the bag (B).

Referring to FIGS. 2 and 3, another conventional clip device (C) is used for sealing a bag (H). The clip device (C) consists of an elongated pressing plate (C1) and an elongated base plate (C2) which are pivotally interconnected at end portions thereof. The base plate (C2) has a pair of retaining hole portions (C22) which are located at a distal end thereof, and a slot (C21) which is formed along the length of the base plate (C2). The pressing plate (C1) includes a pair of engagement tongue portions (C12) which are located at a distal end thereof and over the retaining hole portions (C22) of the base plate (C2) so as to move downward to engage the retaining hole portions (C22) respectively, and a tooth portion (C11) which extends along the length of the pressing plate (C1) and which has the same length as that of the slot (C21). Accordingly, when the bag (H) is placed on the base plate (C2) under the press plate (C1) in such a manner that the cutout portion (not shown) of the bag (H) is located on one side of the base plate (C2), the engagement tongue portions (C12) of the pressing plate (C1) can be brought into engagement with the retaining hole portion (C22) of the base plate (C2) so that the tooth portion (C11) of the pressing plate (C1) presses the bag (H) into the slot (C21) of the base plate (C2) (see FIG. 2), thereby sealing the bag (H).

The drawbacks of the conventional clip device (C) are as follows:

1. Because only one sealing line is provided, the conventional clip device (C) cannot effectively establish an air-tight seal between the exterior and interior of the bag (H) due to the cracks which are formed.
2. In order to clamp the bag (H) effectively, the conventional clip device (C) cannot be made too long, thereby limiting the applicability of the conventional clip device (C).
3. To clamp the bag (H) completely, the bag (H) has to be squeezed into the slot (C21). As a result, the squeezed bag (H) within the conventional clip device (C) may result in the deformation of the pressing plate (C1) and the base plate (C2).

SUMMARY OF THE INVENTION

An object of this invention is to provide a clip device which can effectively establish an air-tight seal between the interior and exterior of a bag which has a cutout portion.

Another object of this invention is to provide a clip device which can be easily and quickly operated to seal the cutout portion of a bag.

According to this invention, a clip device includes an elongated base plate, an elongated pressing plate connected pivotally to the base plate, and an elongated elastic block fixed on the base plate under the pressing plate.

The elongated base plate has a first pivot portion located at an end portion thereof, and two adjacent flexible retaining portions located at the other end portion of the base plate. Each of the retaining portions has a vertical body and a barb-like upper end. The barb-like upper ends respectively extend outward from the vertical bodies in opposite horizontal directions.

The elongated pressing plate has a second pivot portion located at an end portion thereof and mounted pivotally on the first pivot portion of the base plate, and two engagement hole portions located at the other end portion of the pressing plate and over the retaining portions of the base plate. The engagement hole portions can be turned downward to engage the retaining portions of the base plate respectively when the retaining portions are pushed inward.

The elongated elastic block is fixed on the top surface of the base plate between the first pivot portion and the retaining portions. The bottom surface of the pressing plate contacts the top surface of the elastic block on at least one continuous contact line which extends from one end portion of the elastic block to the other end portion of the elastic block.

Accordingly, when a bag with a cutout portion is placed on the top surface of the elongated elastic block under the pressing plate in such a manner that the cutout portion of the bag is located on one side of the elastic block, the engagement hole portions of the pressing plate can be brought into engagement with the retaining portions of the base plate so as to press the bag against the top surface of the elastic block, thereby compressing the elastic block along the contact line to seal the bag. Because the elastic block is compressed along the contact line, an air-tight seal is effectively established between the interior and exterior of the bag.

BRIEF DESCRIPTION OF THE DRAWING

Other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
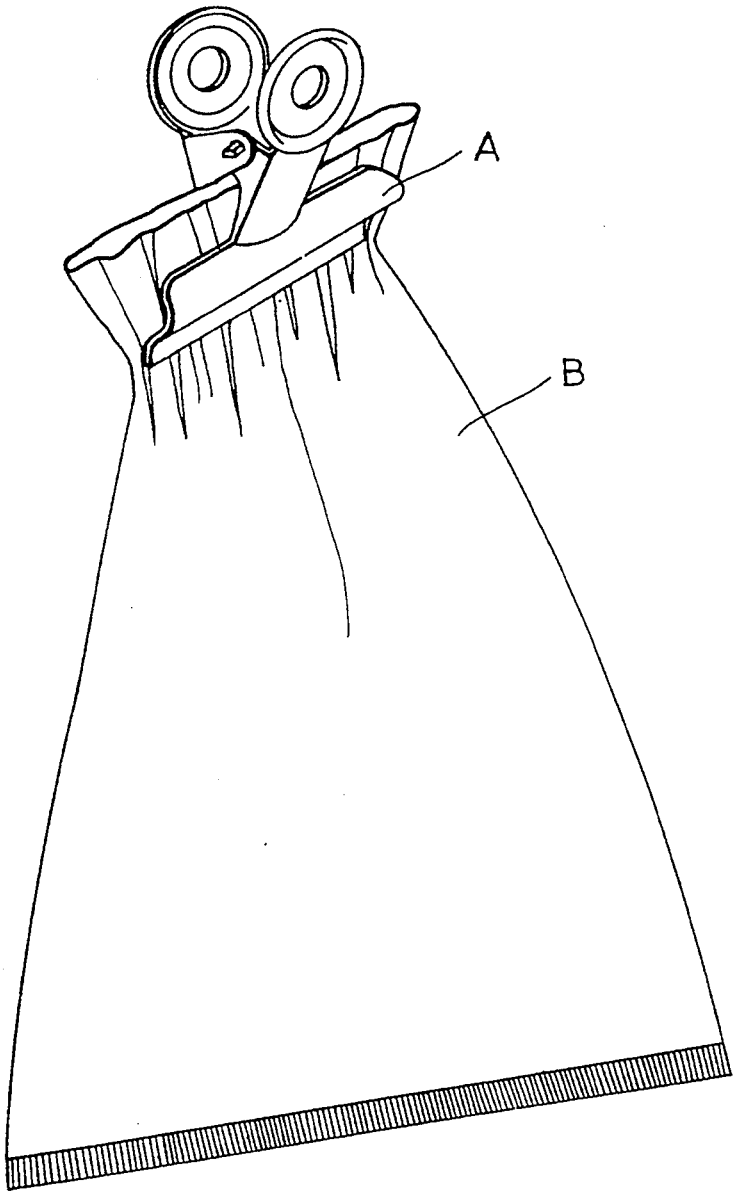
FIG. 1 (PRIOR ART)
FIG. 1 is a schematic view illustrating how a conventional clip device clamps a bag.
Figure 2:
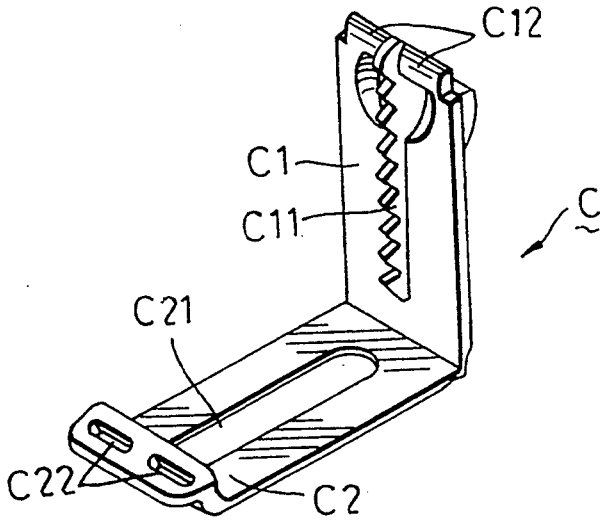
FIG. 2 (PRIOR ART)
FIG. 2 is a perspective view of another conventional clip device.
Figure 3:
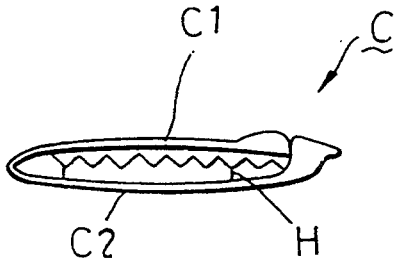
FIG. 3 (PRIOR ART)
FIG. 3 a schematic view illustrating how the conventional clip device of FIG. 2 clamps a bag.
Figure 4:
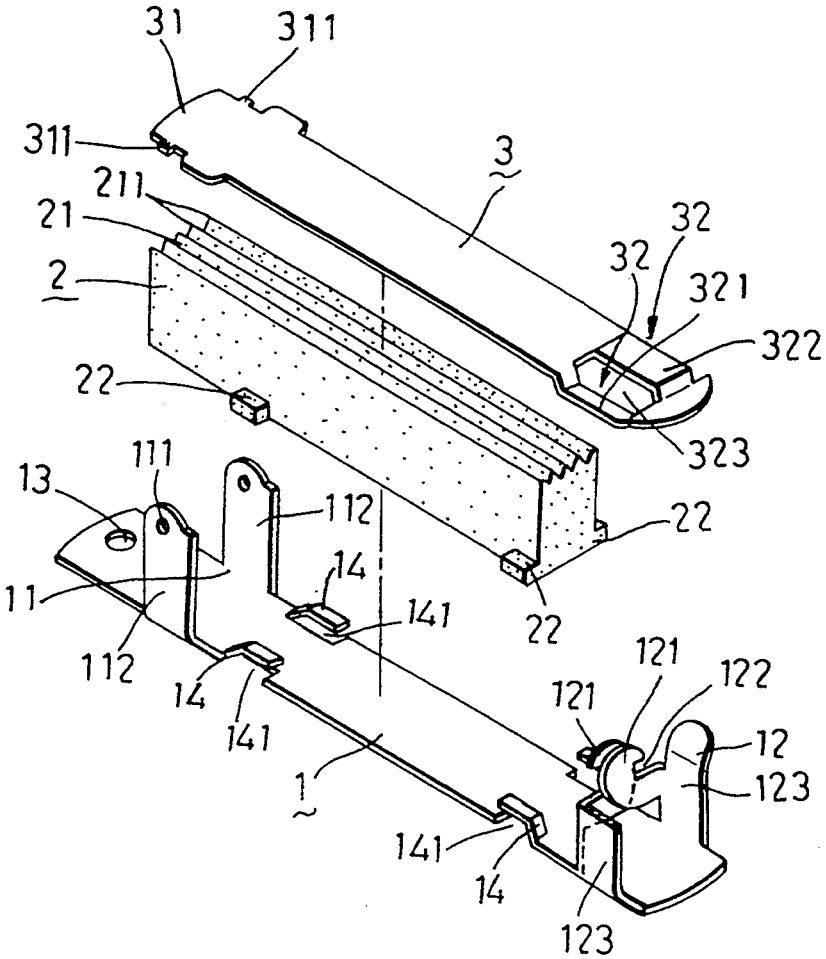
FIG. 4 is an exploded view showing a clip device according to the first embodiment of this invention.

Referring to FIG. 4, the clip device of the first embodiment of this invention includes an elongated base plate 1, an elongated pressing plate 3 connected pivotally to the base plate 1, and an elongated elastic block 2 fixed on the base plate 1 under the pressing plate 3.

The elongated base plate 1 is made of metal and has a first pivot portion 11 located at an end portion thereof, two adjacent flexible retaining portions 12 located at the other end portion of the base plate 1, and two pairs of retaining plates 14 spaced apart from each other at a predetermined distance. An acceptance space is defined between the first pivot portion 11 and the retaining portions 12. Each adjacent pair of the retaining plates 14 are aligned with each other and extend upward from two opposite sides of the base plate 1 so that each of the retaining plates 14 defines a restricted gap 141. The first pivot portion 11 includes two aligned vertical plates 112 projecting upward from two opposite sides of the base plate 1. Each of the vertical plates 112 has a pivot hole 111 formed in the upper end section thereof. Each of the retaining portions 12 has a vertical body 123 and a barb-like upper end 121 with a curved top surface. The vertical bodies 123 project upward from two opposite sides of the base plate 1. The barb-like upper ends 121 respectively extend outward from the upper ends of the vertical bodies 123 in opposite horizontal directions and define restricted gaps 122 therein. The vertical bodies 123 are pushed inward to reduce the total width thereof. The base plate 1 further includes a hanging hole 13 formed therethrough so that the clip device can be hung on an article.

The elongated pressing plate 3 has a second pivot portion 31 located at an end portion thereof, and two engagement hole portions 32 located at the other end portion of the pressing plate 3 and over the retaining portions 12 of the base plate 1. The second pivot portion 31 has two pivot pins 311 that are aligned with each other and that extend from two opposite sides of the pressing plate 3 to engage the pivot holes 111 of the first pivot portion 11 so that the second pivot portion 31 of the pressing plate 3 is mounted pivotally on the first pivot portion 11 of the base plate 1. Each of the engagement hole portions 32 includes a lower block plate 321, an upper block plate 322, and an engagement hole 323 formed between the lower and upper block plates 321, 322. The engagement hole portions 32 have a common upper block plate 322. Accordingly, the engagement hole portions 32 can be turned downward to engage the retaining portions 12 respectively, as shown in FIG. 5, in such a manner that the lower block plates 321 can slide along the curved top surfaces of the barb-like upper ends 121 when the vertical bodies 123 of the retaining portions 12 are pushed inward so as to allow the barb-like upper ends 121 to pass through the engagement holes 323 (see FIG. 6) of the engagement hole portions 32 by the restoration force of the retaining portions 12, thereby confining the lower block plates 321 of the engagement portion 32 within the restricted gaps 122 of the retaining portions 12.

Figure 5:
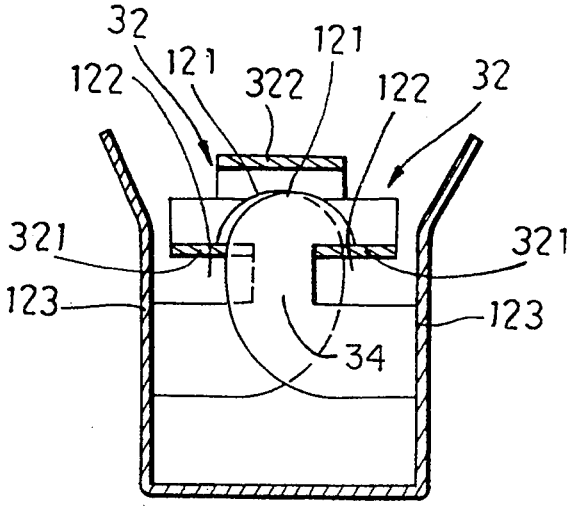
FIG. 5 is a schematic view illustrating the connection of the elongated pressing plate and the elongated base plate of the clip device according to the first embodiment of this invention.

As illustrated in FIG. 5, the barb-like upper ends 121 can overlap each other so that, when the pressing plate 3 is pressed against the barb-like upper end 121, the overlapping portions of the barb-like upper ends are directed simultaneously in a hole 34 of the pressing plate 3;

The elongated elastic block 2 has a ribbed or serrated top surface 21 (see FIG. 7) on which the pressing plate 3 lies and two pairs of lugs 22, each pair of which project from the lower ends of two sides of the elastic block 2. The elastic block 2 is fixed in the acceptance space of the base plate 1 in such a manner that the lugs 22 are respectively confined within the restricted gaps 141 of the retaining plates 14. It is understood that the elastic block 2 may be secured to the base plate 1 by screws or glue, or in any other suitable manner. The ribbed top surface 21 has five parallel ribs 211 extending along the length of the elastic block 2 so that the pressing plate 3 contacts the top surface of the ribs 211.

Figure 7:
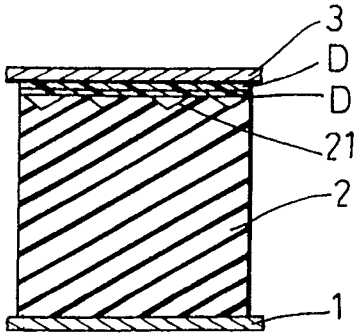
FIG. 7 is a sectional view illustrating how a bag is clamped with the use of the clip device of the first embodiment of this invention.

Referring to FIG. 7, when a bag (D) is placed on the ribbed top surface 21 of the elongated elastic block 2 under the pressing plate 3 in such a manner that the cutout portion (not shown) of the bag (D) is located on one side of the elastic block 2, the engagement hole portions 32 of the pressing plate 3 can be brought into engagement with the retaining portions 12 of the base plate 1 so as to press the bag (D) against the ribbed top surface 21 of the elastic block 2, thereby compressing the elastic block 2 to seal the bag (D). Because the ribs 211 are compressed, an air-tight seal can be effectively established between the interior and exterior of the bag (D).

When it is desired to remove the bag (D) from the clip device, the retaining portions 12 are pushed inward so that the restoration force of the elastic block 2 urges the engagement hole portions 32 of the pressing plate 3 to turn upward, thereby disengaging the retaining portions 12 from the engagement hole portions 32 of the pressing plate 3.

Figure 8:
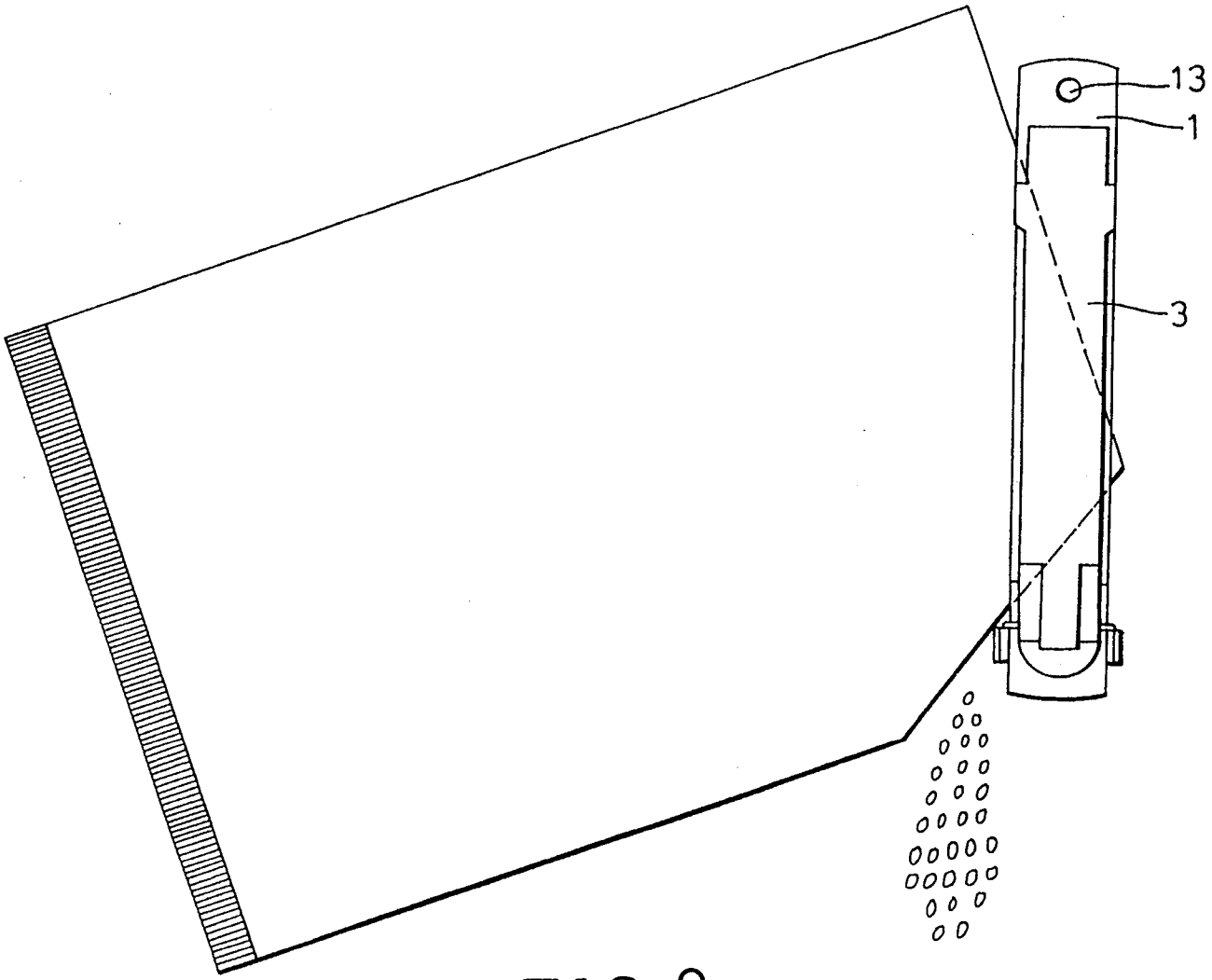
FIG. 8 is a schematic view illustrating the application of the clip device according to the first embodiment of this invention.

FIG. 8 illustrates the application of the clip device of this invention. As illustrated, the clip device can be used for reducing the size of the opening of the bag by adjusting the position where the clip device clamps the cutout portion of the bag.

Figure 9:
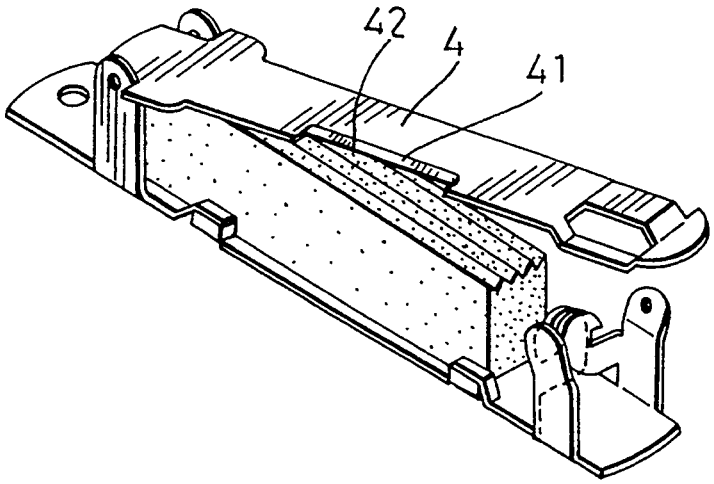
FIG. 9 is a perspective view of the clip device according to the second embodiment of this invention.

FIG. 9 shows the elongated pressing plate 4 of the second embodiment of this invention. The pressing plate 4 includes a recess portion 42 formed in a side thereof, and a blade 41 secured in the recess portion 42.

Figure 10:
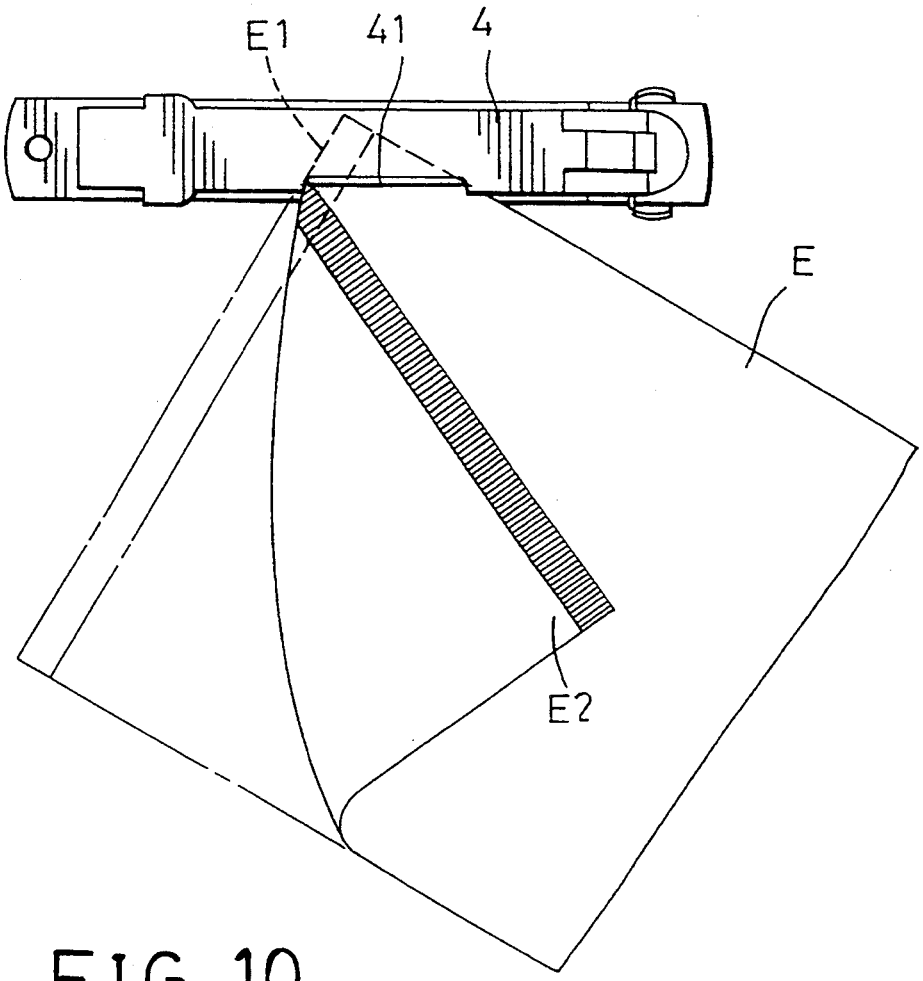
FIG. 10 is a schematic view illustrating the use of the blade of the clip device according to the second embodiment of this invention.

Referring to FIG. 10, when clamped between the pressing plate 4 and the elastic block, the bag (E) can be pulled away from the clip device so as to cut open the bag (E), thereby separating a portion (E1) of the bag (E), which portion (E1) is clamped by the clip device, from the remainder (E2) of the bag (E).

Figure 11:
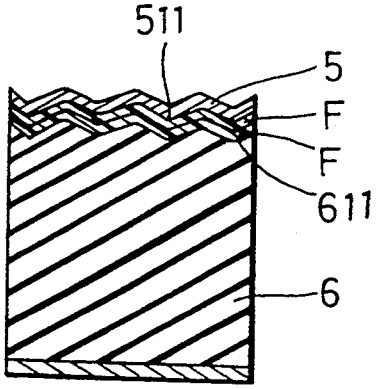
FIG. 11 is a sectional view illustrating the use of a clip device according to the third embodiment of this invention.

FIG. 11 shows another modified pressing plate 5 of this invention. The pressing plate 5 has a ribbed or serrated bottom surface which has four ribs 511 extending along the length of the pressing plate 5. Each of the ribs 511 of the pressing plate 5 is located between an adjacent pair of the ribs 611 of the elastic block 6 so as to clamp a bag (F) therebetween. Because the elastic block can be compressed by the pressing plate to seal the cutout portion of the bag, the number of the ribs of the pressing plate and the elastic block can be changed to 0 or 1 so long as the bottom surface of the pressing plate contacts the elastic block on at least one continuous contact line which extends from one end portion of the elastic block to the other end portion of the elastic block. That is to say, even if the bottom surface of the pressing plate and the top surface of the elastic block are planar, an air-tight seal can still be established between the interior and exterior of the bag which is clamped in the clip device of this invention.

Figure 6:
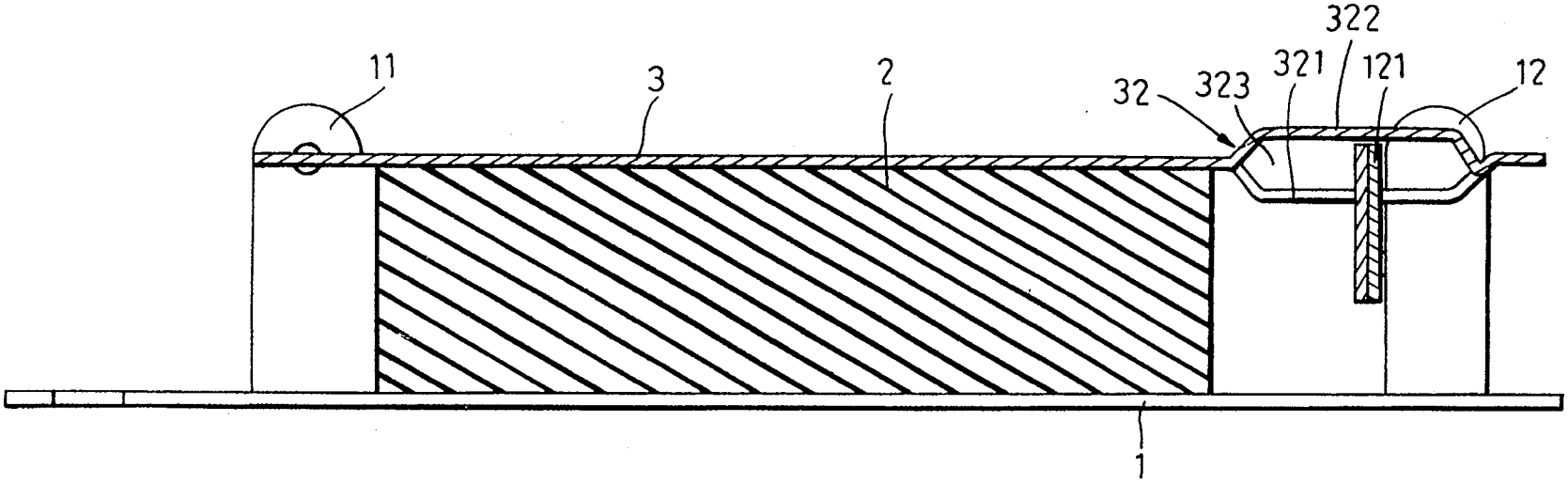
FIG. 6 is a sectional view illustrating the clip device according to the first embodiment of this invention.

Although in the embodiment shown in FIG. 6 all of the side views of the base plate 1, the elastic block 2 and the pressing plate 3 are generally straight, but may be modified into curved form, serrated form, or any other suitable shape.

It is understood that the clip device has other applications. For example, the clip device may be used as a hairpin.

With this invention thus explained, it is apparent that numerous modifications and variations can be made without departing from the scope and spirit of this invention. It is therefore intended that this invention be limited only as indicated in the appended claims.

I claim:

1. A clip device for sealing a bag, said bag having a cutout portion, said clip device comprising:

an elongated base plate having a first pivot portion located at an end portion thereof, and two adjacent flexible retaining portions located at the other end portion of said base plate, each of said retaining portions having a vertical plate member and a barb-like member, said barb-like members of said retaining portions extending toward each other from said vertical plate members and normally overlapping each other, said vertical plate members lying in planes which are perpendicular to a direction of each of said barb-like members;

an elongated pressing plate having a second pivot portion located at an end portion thereof and mounted pivotally on said first pivot portion, and an engagement hole located at the other end portion of said pressing plate and over said retaining portions, said engagement hole receiving simultaneously portions of said barb-like members which overlap when said other end portion of said pressing plate is pressed against said retaining portions; and an elongated elastic block fixed on a top surface of said base plate between said first pivot portion and said retaining portions in such a manner that a bottom surface of said pressing plate contacts a top surface of said elastic block on at least one continuous contact line which extends from one end portion of said elastic block to the other end portion of said elastic block;

whereby, when said bag is placed on the top surface of said elongated elastic block under said pressing plate in such a manner that said cutout portion of said bag is located on one side of said elongated elastic block, said engagement hole of said pressing plate can be brought into engagement with said retaining portions of said elongated base plate so as to press said bag against the top surface of said elongated elastic block, thereby compressing said elongated elastic block to seal said bag.

2. A clip device for sealing a bag as claimed in claim 1, wherein said elastic block has a ribbed top surface with at least one rib extending from one end portion thereof to the other end portion.

3. A clip device as claimed in claim 1, wherein said base plate has a hanging hole formed therethrough so that said clip device can be hung on an article.

4. A clip device as claimed in claim 1, wherein said pressing plate includes a recess portion formed in a side thereof, and a blade secured in said recess portion, whereby, when clamped between said pressing plate and said block in position, said bag can be pulled away from said clip device so as to cut open said bag, thereby separating a portion of said bag clamped by said clip device from a remainder of said bag.

5. A clip device as claimed in claim 1, wherein said pressing plate has a planar bottom surface.

6. A clip device as claimed in claim 1, wherein said top surface of said elastic block has a plurality of ribs.

7. A clip device as claimed in claim 6, wherein said pressing plate has a ribbed bottom surface which has a plurality of ribs extending along a length of said pressing plate, each of said ribs of said pressing plate being located between an adjacent pair of said ribs of said elongated elastic block.

8. A clip device as claimed in claim 1, wherein said elongated pressing plate comprises an upper block plate integrally formed therewith above said engagement hole to cover said barb-like members.

* * * * *